US005553345A

United States Patent [19]

Bell

[11] Patent Number: 5,553,345

[45] Date of Patent: Sep. 10, 1996

[54] CLIP-ON TOWEL

[76] Inventor: Steven Bell, 5523 Miles Ct., Springfield, Va. 22151

[21] Appl. No.: 310,015

[22] Filed: Sep. 21, 1994

Related U.S. Application Data

[63] Continuation-in-part of Ser. No. 92,838, Jul. 16, 1993, abandoned.

[51] Int. Cl.[6] ..... A47K 10/02; A47K 10/12

[52] U.S. Cl. ..... 15/209.1; 24/3.11; 224/255; 224/269; 224/932; 224/669; 224/668; 224/670; 248/689

[58] Field of Search ..... 15/208, 209.1, 15/210.1; 24/3.1, 3.11, 3.12, 3.2, 510, 511; 224/252, 255, 269, 932; 248/689

[56] References Cited

U.S. PATENT DOCUMENTS

| | | | |
|---|---|---|---|
| 457,196 | 8/1891 | Grant | 24/510 |
| 620,677 | 3/1899 | Schuck | 24/510 |
| 1,393,577 | 10/1921 | Ryason | 24/510 |
| 1,726,185 | 8/1929 | Kremski et al. | 24/510 |
| 2,754,532 | 7/1956 | Kanehl et al. | 15/209.1 |
| 2,862,219 | 12/1958 | Kaczanowski | 224/255 |
| 3,040,357 | 6/1962 | Belleni | 15/209.1 |
| 4,536,925 | 8/1985 | Boothe et al. | 24/3.11 |
| 5,147,703 | 9/1992 | Provost et al. | 15/209.1 |

*Primary Examiner*—Mark Spisich
*Attorney, Agent, or Firm*—Rader, Fishman & Grauer PLLC

[57] ABSTRACT

A clip-on towel is disclosed for use in sports and other activities where a readily accessible towel is advantageous. A first embodiment of the clip-on towel includes a clip portion that fits through an aperture in a towel portion and is adapted to engage the waistband of a user. The clip portion is attached to the towel by way of a restricted aperture thus eliminating the need for employing fasteners to attach the clip to the towel. A second embodiment includes a clip that is sewn to the towel and features a break away finger portion. If excessive force is applied to the clip, the towel breaks away from the user. The clip can be reassembled after breaking away inasmuch as it is designed to non-destructively separate.

18 Claims, 4 Drawing Sheets

FIG 15
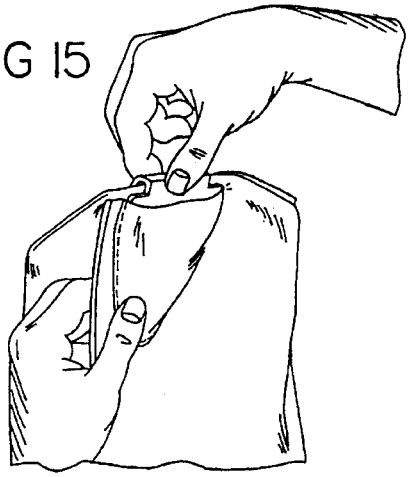
FIG 16
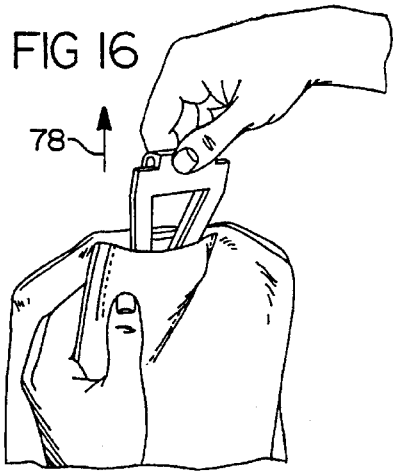
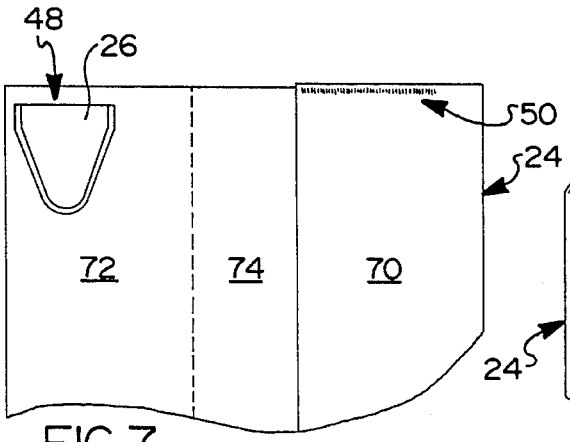
FIG 7
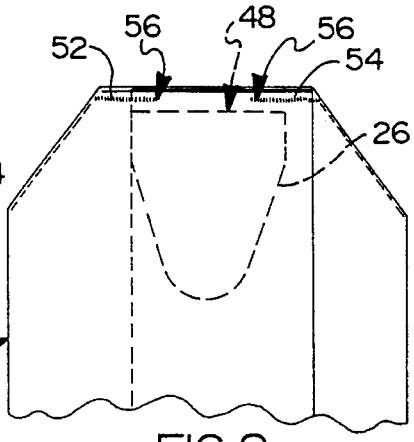
FIG 8
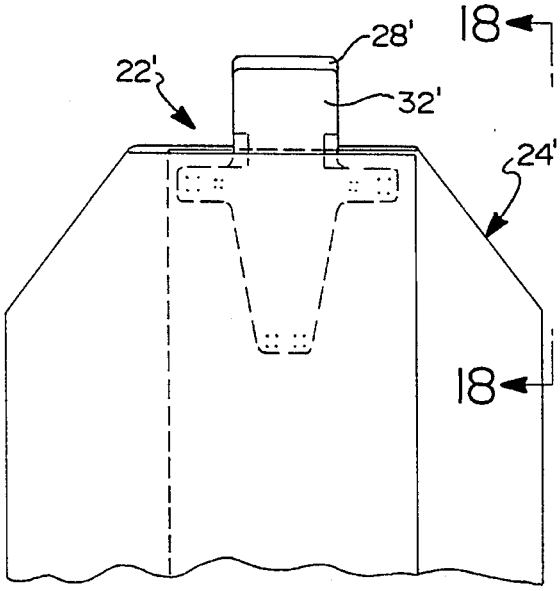
FIG 17
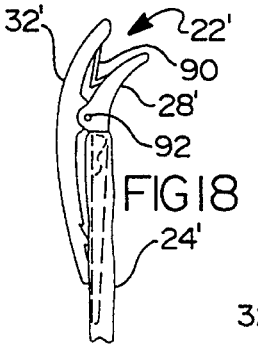
FIG18
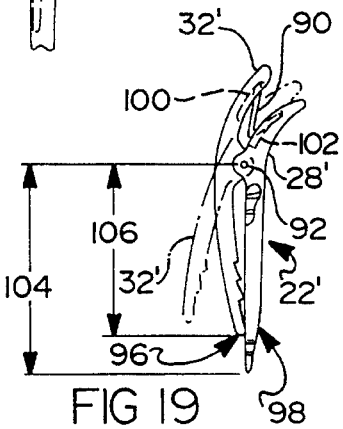
FIG 19

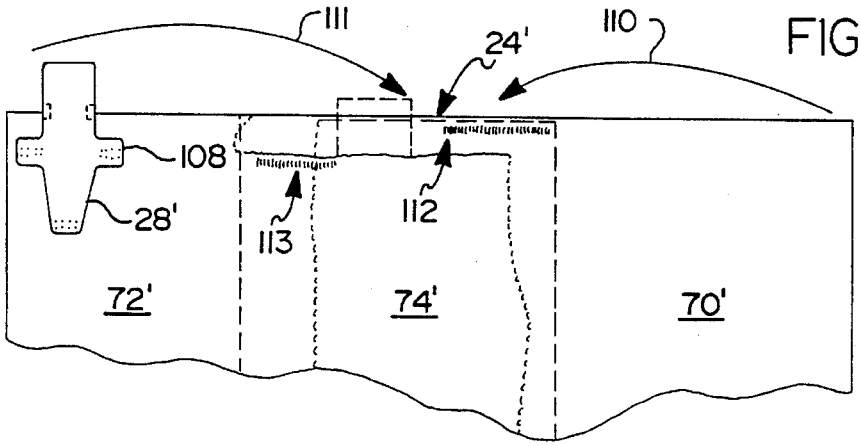
FIG 20
FIG 21
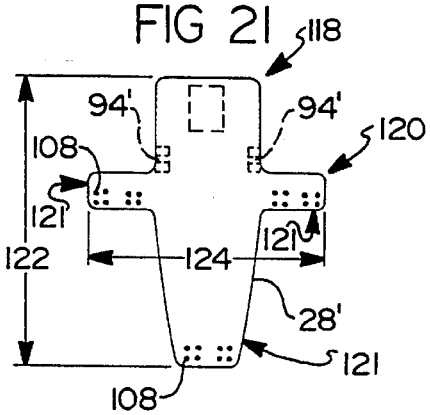
FIG 22
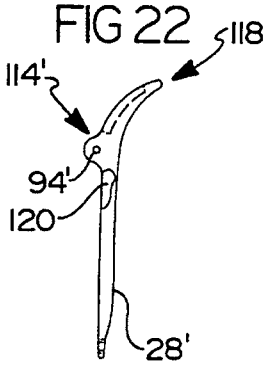
FIG 23
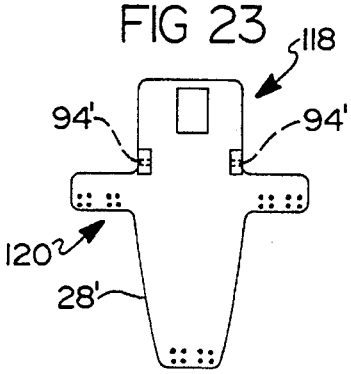
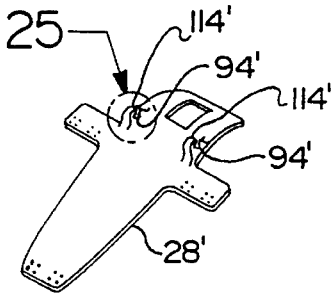
FIG 24
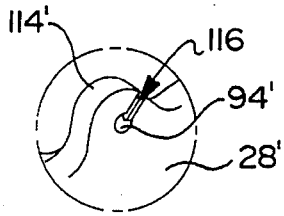
FIG 25
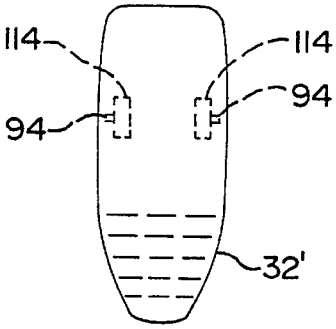
FIG 26
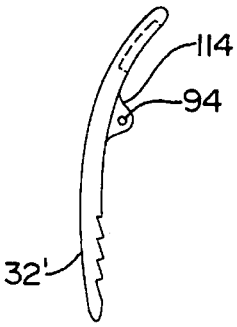
FIG 27
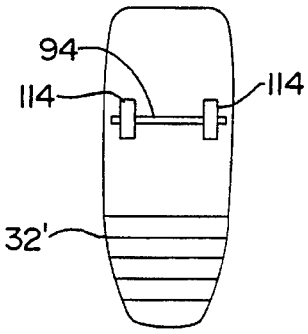
FIG 28

CLIP-ON TOWEL

This is a continuation-in-part of application Ser. No. 08/092,838 filed on Jul. 16, 1993abandoned.

TECHNICAL FIELD

The present invention generally relates to towels and more particularly relates to towels that are quickly and easily attached to and removed from a person's outer garments.

BACKGROUND OF THE INVENTION

Towels which are designed to be attached to the belt or pants of a wearer are well known. For example, U.S. Pat. No. 4,403,366 discloses a removable towel means for mounting on the belt, pants, or accessories worn by or in the possession of the user. This patent discloses a towel which is attached to a clip by means of a hook and loop fastener. The hook and loop fastener allows the clip to be separated from the towel during washing. Although this device is useful for the disclosed purposes, the hook and loop fastener adds an undesirable cost and may tend to become inoperative after multiple washings.

U.S. Pat. No. 2,754,532 discloses a sportsman's towel. This towel is attached to the belt of a wearer by way of a strap which is folded over to provide a loop held in place by snaps. This system has the disadvantage of only working in cooperation with a belt, or a loop fashioned on the wearer's apparel. Thus, for wearers not employing a belt or loop, the attachment means set out therein is ineffective. Also, it is costly to construct strap 12 employing a plurality of snap fasteners and may be dangerous to the wearer if the towel is entangled in moving objects or the like.

Thus, in view of the above shortcomings of known systems, it is desirable to provide a clip-on towel which is easy to use and which can be manufactured cost effectively.

It is also an object of this invention to provide a clip-on towel which is easily attached and detached to the waistband, or other appropriate apparel of the wearer.

It is a further object of this invention to provide a clip-on towel wherein the clip-on portion of the towel is easily separated from the towel to facilitate washing of the towel.

SUMMARY OF THE INVENTION

In light of the foregoing objects, the present invention provides a clip comprising a generally planar face portion having an opening therein, the planar face portion having a first width and extending upwardly and inwardly forming a narrowing neck portion having a second width, the narrowing neck portion extending downwardly forming a retaining finger portion having a third width, wherein the first width is greater than the second width and the second width is at least as great as the third width.

Preferably the generally planar face includes a triangular perimeter and, preferably, the retaining finger portion is generally disposed adjacent the opening in the generally planar face portion.

In a preferred embodiment, the retaining finger portion includes an end portion having a flared contour directed away from the generally planar face portion.

The clip is preferably comprised of a substantially inflexible plastic and the retaining finger is generally triangular.

Preferably, the generally planar face portion is generally parallel to the retaining finger.

In another aspect, the present invention discloses a clip-on towel including a clip and a towel. The towel includes a slot there through having a first width, the clip includes a body portion having a second width, a neck portion extending from the body portion having a third width, and the neck portion extending downwardly to form a retaining finger having a fourth width. The second width is preferably greater than the third width and the third width is generally equal to the first width. The first width is at least as great as the fourth width. The retaining finger preferably extends through the slot in the towel and is adapted to be supported from the apparel of a wearer.

In a preferred embodiment the body portion of said clip is generally planar and includes a generally triangular perimeter. The body portion preferably includes an aperture there through and the retaining finger is preferably generally disposed adjacent to the aperture.

The towel preferably includes a pocket portion disposed adjacent to the slot and the body portion of the clip is slidingly received and resides within the pocket.

The towel is preferably folded upon itself to drape over the pocket thereby generally concealing the pocket and the clip-on towel is constructed so that preferably not more than one layer of towel resides between the retaining finger and the body portion of the clip.

In a second embodiment of the clip of the present invention, the clip is provided with a body portion, a finger portion, and a pivot for pivotally connecting the body portion to the finger portion. The body portion is attached to a fabric preferably a towel-like fabric. The pivot is designed to allow nondestructive separation between the body portion and the finger portion. Thus, if excessive force acts to separate the body portion from the finger portion, the clip simply separates.

Other advantages and meritorious features of the present invention will become more fully understood from the following description of the preferred embodiments, the appended claims and the drawings, a brief description of which follows.

BRIEF DESCRIPTION OF THE DRAWINGS

FIG. 7 is a plan view of the towel of the present invention having its right most third folded and sewn upon itself.

FIG. 8 is a plan view of the towel of the present invention having its left most third folded and sewn upon itself.

FIGS. 12–16 are perspective views showing how the clip of the present invention is removed, installed, and retained within the towel of the present invention.

FIG. 17 is a front view of a second embodiment of the clip of the present invention shown attached to a towel.

FIG. 18 is a partial side view taken substantially along lines 18–18 of FIG. 17.

FIG. 19 is a side view of the clip of FIG. 18 with the towel portion removed.

FIG. 20 shows the towel and clip assembly of FIG. 17 wherein the towel is unfolded.

FIG. 21 is a front view of the second embodiment of the clip of the present invention.

FIG. 22 is a side view of the clip of FIG. 21.

FIG. 23 is a back view of the clip of FIG. 21.

FIG. 24 is perspective view of the back portion of the clip of FIG. 21.

FIG. 25 is a partial enlarged view of the slot of FIG. 24.

FIG. 26 is a front view of the finger portion of the second embodiment of the clip of the present invention.

FIG. 27 is a side view of the clip of FIG. 26.

FIG. 28 is a back view of the clip of FIG. 26.

DETAILED DESCRIPTION OF THE PREFERRED EMBODIMENTS

Figure 1:
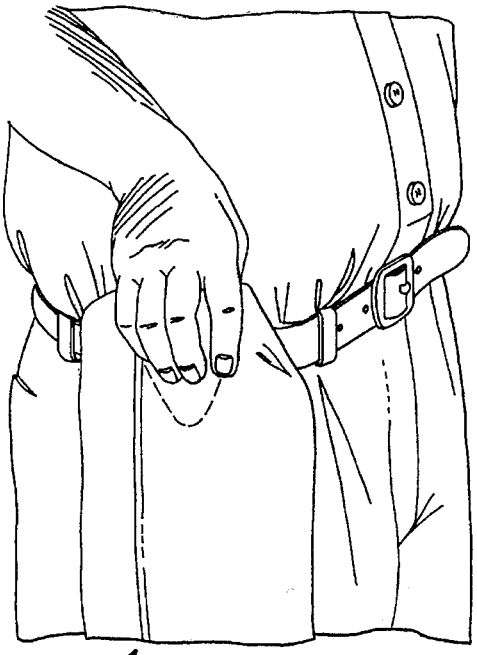
FIG. 1 is a partial perspective view of a wearer donning the clip-on towel of the present invention.

Now referring to FIG. 1 clip-on towel 20 is designed to be primarily worn around the waistband of a wearer. Although FIG. 1 depicts the wearer wearing a belt, clip-on towel 20 works equally well on non-belted apparel. Also, even though clip-on towel 20 is designed to be primarily worn around the waistband, it functions equally well when clipped to a pocket, cuff, or the like.

Figure 2:
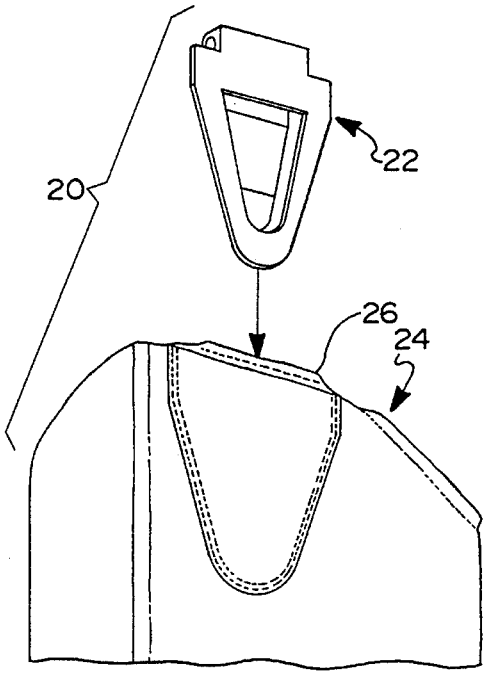
FIG. 2 is a partial exploded view of the clip and towel portions of the present invention.
Figure 3:
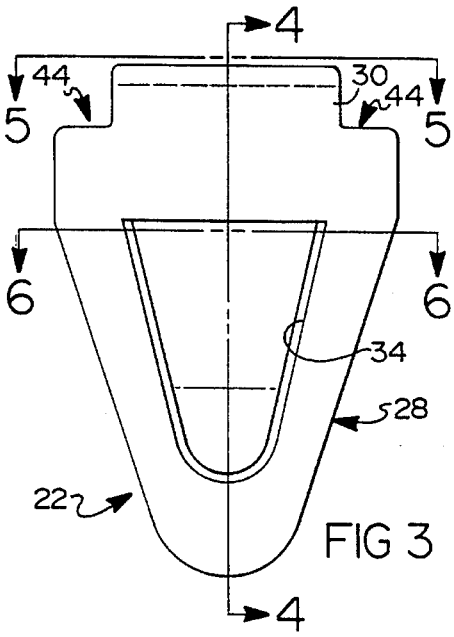
FIG. 3 is a front view of the clip portion of the present invention.
Figure 4:
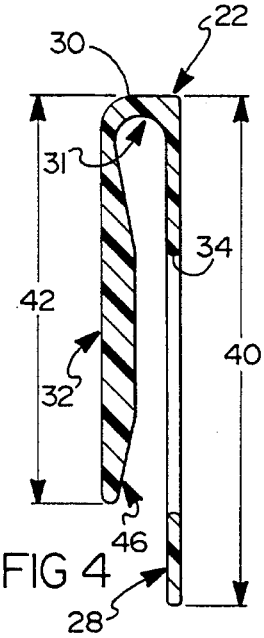
FIG. 4 is a cross-sectional view taken substantially along lines 4—4 of FIG. 3.
Figure 5:
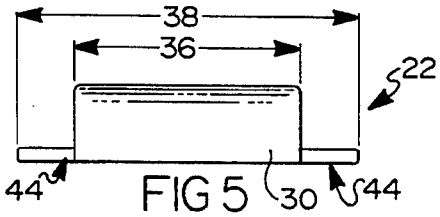
FIG. 5 is a top view taken substantially along lines 5—5 of FIG. 3.
Figure 6:
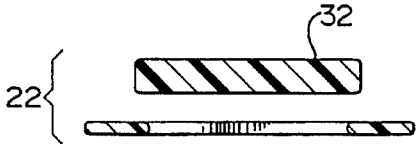
FIG. 6 is a cross-sectional view taken substantially along lines 6—6 of FIG. 3.

Now referring to FIG. 2, clip-on towel 20 includes clip portion 22 and towel portion 24. Towel 24 is fashioned with pocket 26 which houses a body portion of clip 22 (this will be later discussed in detail).

Now referring to FIGS. 3–6, clip 22 includes body portion 28, narrowing neck portion 30, byte portion 31, and retaining finger 32. Body 28 is generally planar and includes generally triangular shaped aperture 34. Body portion 28 and retaining finger 32 are both preferably generally triangular in shape.

Neck 30 is formed from an upward extension of body 28 and is narrower 36 than width 38 of body 28. Neck 30 extends into byte portion 31 and thereafter extends downwardly to form retaining finger 32. Retaining finger 32 is generally parallel to and spaced from planar body 28.

Planar body 28 is preferably longer in length 40 than the length 42 of finger 32. Finger 32 is generally disposed adjacent aperture 34. Shoulder 44 is formed in the region between neck portion 30 and body portion 28. The function of shoulder 44 will be explained in conjunction with FIGS. 9–16.

Body 28 is preferably formed from substantially resilient, firm plastic. Finger 32 preferably includes flared contour 46 near its lowermost end.

Now referring to FIGS. 7 and 8, towel 24 preferably includes pocket 26 sewn in an upper corner thereof. Pocket 26 is fashioned such that opening 48 resides in the upper end thereof. Pocket 26 is sized to generally accept body portion 28 of clip 22. Pocket 26 is preferably sewn within towel 24; however, other means of attachment may be used. Preferably, towel 24 is folded in thirds (not necessarily of equal dimension) forming a right third 70, a left third 72, and a middle third 74. The right third is preferably sewn along its upper edge 50 and the left third is folded over the right third and sewn in two locations 52, 54 (see FIG. 8). Sewing locations 52, 54 are discontinuous thereby forming opening 56 within towel 24. Opening 56 is sized approximately equal to width 36 of neck 30. Accordingly, finger 32 easily fits through opening 56 but shoulder 44 of body 28 will not pass there through.

In its most preferred embodiment, towel 24 is folded into thirds of unequal dimension with the left and right thirds approximately one inch to three inches shorter than the middle third (that is to say, the two side folds 70, 72 are greater than 50 percent but less than 100 percent of the width of middle fold 74). This folding pattern is believed to be unique inasmuch as it offers an optimum combination of compactness plus ease of use of the entire towel surface. If the towel is folded into thirds of equal dimension, the towel tends to be cumbersome to open and thus discourages the full use of the inside towel surfaces.

Figure 9:
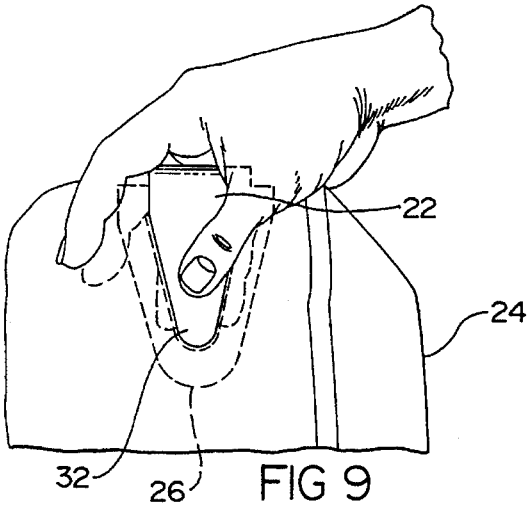
FIGS. 9–11 are perspective views showing how the clip-on towel of the present invention is donned using one hand.
Figure 10:
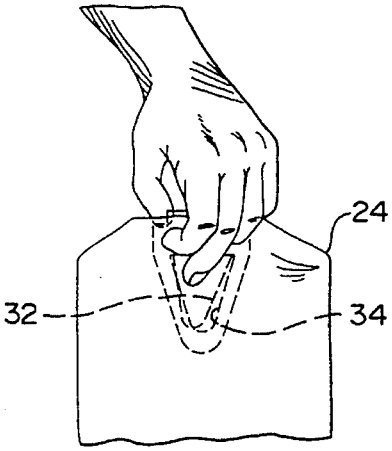
Figure 11:
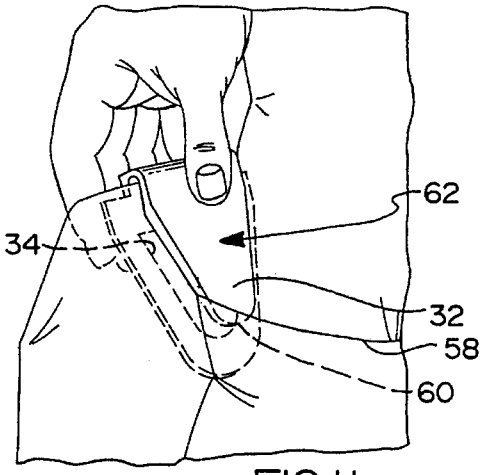
Figure 12:
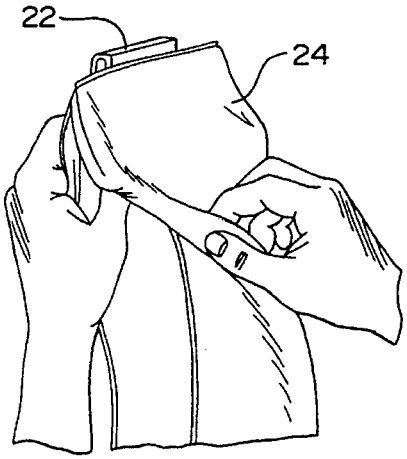
Figure 13:
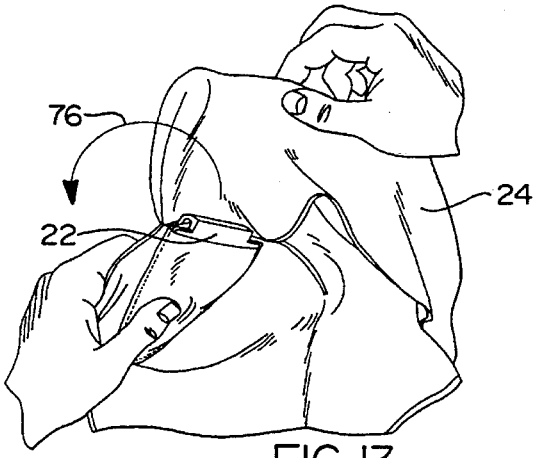
Figure 14:
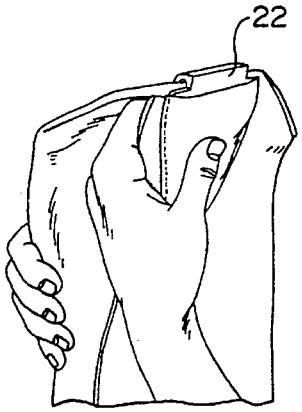

Now referring to FIGS. 9–11, clip 22 resides within pocket 26 of towel 24. Aperture 34 allows the user to access retaining finger 32 to flex retaining finger 32. This flexing permits finger 32 to move away from body 28 thereby enlarging the distance between finger 32 and body 28 and facilitating sliding retaining finger 32 over waistband 58. Thus, the attachment of clip-on towel 20 over waistband 58 is easily accomplished with one hand. Rounded tip 60 of finger 32 faces against the user's body and is designed to slide easily over waistband 58. Thus, rounded tip 60 is superior than a wider, blunter end which tends to hand up on the user's apparel during the donning process. Face 62 of finger 32 is preferably smooth to prevent poking or otherwise irritating the user along the area of contact with the user. Flared contour 46 (see FIG. 4) allows finger 32 to more easily slip over the waistband without necessitating visual cues.

Body 28 is preferably longer 40 (see FIG. 4) than the length 42 of finger 32. This allows the user to easily grasp clip 22 in one hand. By placing pressure on finger 32 to spread finger 32, the clip-on towel is easily donned by placing the clip against the body below the waistband, drawing clip 22 upward until finger 32 moves across waistband 58, and moving clip 22 downward thereby securing finger 32 over waistband 58. Thus, clip 22 of the present invention allows the user to don clip-on towel 20 easily with one hand and without visual cues.

The gripping action of clip 22 is formed between finger 32 and body 28. Finger 32 is preferably generally triangular and sized to fit within triangular aperture 34 of body 28. With both of these members triangularly shaped and finger 32 positioned substantially over aperture 34, a gripping area is formed between triangular edges of aperture 34 and edges of finger 32 thereby maximizing the gripping area of clip 22. Preferably clip 22 is designed such that there is no contact between finger 32 and body 28 when the clip is not in use. This allows clip 22 to accommodate waistbands of various thicknesses.

Now referring to FIGS. 12–16 when it is desirable to separate clip 22 from towel 24 (for example when it is desired to wash towel 24), layer 72 of towel 24 surrounding pocket 26 is grasped and the remaining layers of towel 24 are rotated 76 over the top of clip 22 (see FIGS. 13 and 14) thereby exposing clip 22. Clip 22 is then grasped and moved upwardly 78 (see FIGS. 15 and 16) whereby retaining finger 32 is removed from opening 56 and body 28 of clip 22 is removed from pocket 26. When it is time to insert clip 22 into towel 24, the above process is reversed.

Now referring to FIG. 17, second embodiment of clip 22' is shown assembled to towel 24'. One primary difference between first and second embodiments of clip 22' is that the second embodiment of clip 22' is designed to be sewn to towel 24'.

Now referring to FIGS. 17 and 18, clip 22' is comprised of finger portion 32' and a body portion 28' Both finger and body portions 32', 28' respectively share a common concave shape. This common concave shape can be seen from FIG. 18 and generally allows body portion 28' to nest along finger portion 32' When clip 22' is clipped to the waistband 58 of a wearer, the rounded, concave shape of finger portion 32' does not possess and sharp or pointed surfaces which might otherwise irritate the waist area of the wearer. Thus, the second embodiment of the clip of the present invention provides significant comfort.

Now referring to FIGS. 17, 18, and 19, body portion 28' and finger portion 32' are pivotally connected to one another by way of pivot 92. In its preferred embodiment, pivot 92 is simply comprised of a pin 94 (see FIGS. 26–28) which engages aperture 94' (see FIGS. 21–23) fashioned within body portion 28'.

Spring 90 resides between body portion 28' and finger portion 32' thus acting to keep pinching ends 96, 98 of finger portion, body portion 32', 28' respectively urged against one another. Cavities 100, 102 are fashioned within finger portion 32' and body portion 28' respectively to retain spring 90 there between. Spring 90 may taken any number of forms such as the "V" spring shown in FIG. 19 or as a coil spring which is wrapped around pin 94 (coil spring version not shown).

The length 104 of pinching end 98 is preferably longer than the length 106 of pinching end 96. This difference in length 104, 106 is beneficial for easing the attachment of clip 22' to waistband 58 of user.

Now referring to FIG. 20, body portion 28' is preferably attached to towel 24' by way of sewing. It is contemplated that other forms of bonding may be used such as mechanical fasteners, adhesives and thermal bonding. Thermal bonding may be achieved by constructing body portion 28' from a heat activated plastic or the like. Once this material is softened by applying heat, fabric 24' is pressed there against thereby bonding body portion 28' and fabric of the towel 24' once the thermal bonding medium has cooled. Body portion 28' is provided with a plurality of apertures 108 whereby a needle and thread is passed there through to securely attach body portion 28' to towel 24'. After body portion 28' is attached to towel 24', towel 24' is folded into three portions. A right-most first portion 70 is folded 110 onto a central portion 74 and sewn along a top edge thereof 112.

Next, body portion 28' is sewn to the upper left-most corner of towel 24' and this portion of towel 24' is then folded 111 on top of rightmost portion 70 and sewn 113 in place. Thus, the final assembly is that shown in FIG. 17.

BREAKAWAY FINGER PORTION

An important aspect of the present invention is a safety feature which allows towel 24' to be easily and non-destructively detached from waistband 58 of wearer should the towel be caught in moving objects etc. This feature is easily understood in reference to FIGS. 24 through 28. Pin 94 is attached to finger portion 32' by way of raised pads 114. Pin 94 can either be a single pin which passes through both raised pads 114 (as shown in FIG. 28) or can be two separate pads, each of which is mounted to a respectively associated pin (as shown in FIG. 26). Body portion 32' is also furnished with raised pads 114' These raised pads 114' include apertures 94' which are adapted to engage pin 94 and allow pin 94 to pivot therein. Pads 114' include slot 116 which runs from aperture 94' to an outward surface of pad 114'. Thus, if sufficient force is applied against retaining finger 32', pin 94 is permitted to pass through slot 116 thereby separating finger 32' from body portion 28'. As can be easily seen from the construction of pin 94 and aperture 116, once the body portion 28' is separated from finger portion 32', it is easily reattached by simply aligning pins 94 with slot 116 and exerting sufficient force thereon to cause pins 94 to pass through slot 116 and enter aperture 94'.

DESIGN OF BODY PORTION

Now referring to FIGS. 17, 20–23, body portion 28 is designed generally in the form of a cross. Body portion 28 includes longitudinal vertical bar 118 and perpendicular horizontal bar 120. The length 122 of vertical bar 118 is preferably greater than the length 124 of horizontal bar 120. This feature is desirable because it adds to the stability of the towel, holding it close to the body of the wearer (so that the towel does not flap around during activities) and also allows clip 22' to slide over waistband 58 while preventing towel 24' from bunching. Additionally, it provides a large engaging surface against which pinching end 96 of finger portion 32' can engage. In order to maximize the stability of towel 24' when it is worn, it is preferably sewn to body portion 28' at the end most portions 121 of the horizontal and vertical bars. Thus, as can be seen from FIG. 21, apertures 108 are fashioned at the end most portion 121 of bars 118, 120.

The foregoing detailed description shows that the preferred embodiments of the present invention are well suited to fulfill the objects of the invention. It is recognized that those skilled in the art may make various modifications or additions to the preferred embodiments chosen here to illustrate the present invention, without departing from the spirit of the present invention. For example, it is contemplated that any type of mechanical fastener may be used to fasten body portion 28' to towel 24' including metal, plastic, nylon or the like. Also, glues and other forms of chemical processes may also be used. Accordingly, it is to be understood that the subject matter sought to be afforded protection hereby should be deemed to extend to the subject matter defined in the appended claims, including all fair equivalents thereof.

I claim:

1. A clip, comprising:

a body portion, a finger portion, and a pivot for pivotally connecting said body portion to said finger portion, means for attaching said body portion to a fabric, wherein said pivot includes means for allowing non-destructive separation between said body portion and said finger portion wherein said body portion includes a generally cross shaped perimeter.

2. The clip of claim 1, wherein said body portion is longer than said finger portion.

3. The clip of claim 1, wherein said body portion and said finger portion are generally nestingly concave.

4. The clip of claim 1, wherein said body portion and said finger portion each include pinching ends, and said clip further includes means for urging said pinching ends together.

5. The clip of claim 4, wherein said pinching end of said body portion is longer than said pinching end of said finger portion.

6. A clip-on towel assembly, comprising:

a clip, a towel, means for fastening said clip to said towel, said clip including a body portion and a finger portion, a pivot for pivotally joining said finger portion to said body portion, said pivot including means for allowing non-destructive separation between said body portion and said finger portion wherein said body portion is generally cross shaped having a longitudinal vertical bar having a first length and a perpendicular horizontal bar having a second length.

7. The assembly of claim 6, wherein said means for fastening is connected between said towel and an outermost end of at least one of said horizontal and vertical bars.

8. The assembly of claim 7, wherein said first length is greater than said second length.

9. The assembly of claim 8, wherein said first length and said finger portion are nestingly concave.

10. A clip-on towel, comprising:

a clip and a towel, said towel including a slot there through having a first width, said clip including a body portion having a second width, a neck portion extending from said body portion having a third width, said neck portion extending downwardly to form a retaining finger having a fourth width, wherein said second width is greater than said third width and said third width is not greater than said first width wherein said retaining finger is adapted to extend through said slot in said towel and is adapted to be supported from an apparel of a wearer.

11. The clip-on towel of claim 10, wherein said body portion is generally planar and includes a generally triangular perimeter.

12. The clip-on towel of claim 10, wherein said body portion includes an aperture there through.

13. The clip-on towel of claim 12, wherein said retaining finger is generally disposed adjacent said aperture.

14. The clip-on towel of claim 10, wherein said towel includes a pocket portion disposed adjacent said slot and wherein said body portion of said clip is slidingly received and resides within said pocket portion.

15. The clip-on towel of claim 14, wherein said towel is folded upon itself to drape over said pocket portion thereby creating layers generally concealing said pocket portion.

16. The clip-on towel of claim 15, wherein not more than one layer of said towel resides between said retaining finger and said body portion.

17. The clip-on towel of claim 10, wherein said clip is comprised of plastic.

18. The clip-on towel of claim 17, wherein said retaining finger is generally triangular.

* * * * *